United States Patent [19]

Whitehouse

[11] 4,208,936

[45] Jun. 24, 1980

[54] MACHINES FOR CUTTING MEAT AND THE LIKE

[75] Inventor: John A. Whitehouse, Norwich, England

[73] Assignee: AEW Engineering Co. Ltd., Costessey, England

[21] Appl. No.: 950,832

[22] Filed: Oct. 12, 1978

[30] Foreign Application Priority Data

Oct. 17, 1977 [GB] United Kingdom ..... 43037/77
Nov. 16, 1977 [GB] United Kingdom ..... 47594/77

[51] Int. Cl.[2] ..... B26D 4/42; B26D 4/44
[52] U.S. Cl. ..... 83/713
[58] Field of Search ..... 83/713, 715, 716, 714, 83/724, 729, 730

[56] References Cited

U.S. PATENT DOCUMENTS 2,305,177 12/1942 Litty ..... 83/716
2,445,676 7/1948 Lasar ..... 83/716 X

*Primary Examiner*—J. M. Meister

*Attorney, Agent, or Firm*—Donald K. Wedding

[57] ABSTRACT

A jig for bandsaws (typically meat cutting bandsaws) is described. The jig comprises a main frame (10) which is adapted by rollers (18,20) to be received in the guides normally fitted to a bandsaw to receive and guide a sliding table thereon; a sub-frame (26) movable relative to the main frame in a direction perpendicular to the direction of movement dictated by the rollers (18,20); a spring (48) for returning the sub-frame to a rest position on the main frame; a magazine (32) mounted on the sub-frame (26), having a thrust member (76) slidable therealong to enable a slab of meat to be pushed forwardly along the magazine into a position in which its leading end overhangs the end of the magazine and is ready to be severed by a bandsaw blade (82). The thrust member (76) is slidable parallel to the direction of movement of the sub-frame (26) relative to the main frame (10). A squeeze grip actuator (88,90) overcomes the spring resistance, which latter returns the sub-frame in a rearward direction away from the blade (82) when the squeeze grip actuator is released.

13 Claims, 8 Drawing Figures

MACHINES FOR CUTTING MEAT AND THE LIKE

DESCRIPTION

1. Field of Invention

This invention concerns bandsaws and in particular a jig (sometimes referred to as a portioning jig) which can be mounted directly onto such a bandsaw to enable the operator to slice material such as meat into portions. Typically a jig embodying the invention will be used to assist in the cutting of chops from loins or of hamburgers from press-formed and frozen cylinders of meat. However the invention is not limited to such use.

2. Background to the Invention

Hitherto slicing or portioning operations (commonly referred to as reductions) have been carried out by the use of a bandsaw equipped with a half sliding table i.e. one in which that part of the table which is in front of the blade and carries the uncut meat is enabled to move backwards and forwards parallel to the direction of cutting whilst that part of the table behind the blade is fixed in position and usually comprises a flat surface. The slice thickness in such an arrangement is controlled by a stop member (commonly referred to as a portion fence or thickness gauge) which is set to the desired slice thickness by the operator before the slicing or portioning operation is begun. The meat is then held on the moving part of the table by the operator's hand as he moves the table backwards and forwards.

It will be appreciated that this operation is potentially very dangerous since the operator's hands must finally arrive at a position very close to the blade particularly when cutting the last few slices or chops from a section of meat. The purpose of a portioning jig is to enable the bandsaw operator to perform the slicing or portioning operations without the need to bring his hands into the region of the bandsaw blade.

PRIOR ART

British Patent Specification No. 1,209,457 describes a chop-cutting apparatus for cutting chops from loins and the like in which a jig is provided to partially protect the operator from the moving blade of the bandsaw during the portioning operation.

One disadvantage of the apparatus described in the aforementioned specification is that the jig forms an integral part of the bandsaw apparatus and the latter cannot be used for other purposes.

Another disadvantage arises from the need for the apparatus to include a separating strip 23 on the blunt side of the blade which enters into the cut in the loin formed by the blade and prevents the loin moving behind the blade after a chop has been severed from the loin. The strip 23 is also preferably thicker than the cutting blade so as to increase the width of the cut formed by the blade to prevent the cutting blade binding or damaging the chop.

The blade 23 constitutes one more piece of apparatus which must be dismantled and cleaned in order to maintain hygiene standards.

OBJECTS OF THE INVENTION

One object of the present invention is to provide apparatus which does not require the need for such a separating strip such as is required in the apparatus described in G. B. Pat. No. 1,209,457.

Another object of the present invention is to provide apparatus which may be fitted as an optional extra to existing bandsaws in place of the conventional sliding table which usually forms part of a meat-cutting bandsaw.

SUMMARY OF THE INVENTION

According to the present invention a jig for a bandsaw to facilitate the severing of material such as meat into portions and adapted to be fitted to a bandsaw comprises a main frame movable in a first direction parallel to the direction of the cut parallel to a fence situated on the opposite side of the cutting blade, a sub-frame adapted to receive and support a slab of material to be cut and mounted on the main frame and movable relative thereto in a second direction which is generally perpendicular to the said first direction so as to allow the slabs of material to be moved towards and away from the blade, first handle means for effecting the movement of the sub-frame relative to the main frame, a thrust exerting member slidable relative to the sub-frame in the said second direction, second handle means linked to the said thrust exerting member whereby the latter can be pushed forward from a rest position in the said second direction to urge the material on the sub-frame towards and into contact with the said fence, and, means for returning the sub-frame to the said rest position in the event that the operator removes hand pressure from the said first handle means.

Preferably the first handle means is situated remote from the blade.

Preferably the second handle means is shrouded on the side thereof which comes into close proximity with the blade when the thrust exerting member is pushed in a forward direction.

Preferably the sub-frame includes a magazine which is removable from the sub-frame for cleaning and for replacement so that different magazines may be fitted to the jig, to hold different materials or different cuts or sections of meat.

Preferably the main frame is mounted on rolling members which are adapted to run in guide means. Such guide means are conveniently provided on a meat-cutting bandsaw for containing the rolling members on the underside of a sliding table (known per se). A jig embodying this feature of the invention can therefore be readily interchanged with a sliding table on such a machine.

Conveniently the means for retaining the sub-frame includes a spring which is compressed or extended when the sub-frame is pushed forward and which exerts a return force on the sub-frame when the forward pressure is removed.

Preferably the said handle means is of the so-called dead man's handle variety and includes two parts which require a squeeze grip to draw them together and in so doing urge the sub-frame in the said forward direction against the spring return means.

Preferably a plate is provided on the main frame which is mounted so as to provide a support surface parallel to and spaced from the fence for supporting portions of material severed by the blade, behind the latter, by causing them to become sandwiched between the fence and the said plate. Subsequently severed portions displace the earlier portions and the plate ensures that the displaced portions fall away from the jig onto a stationary platform remote from the blade (or into a chute) from which they can be retrieved for further processing such as packaging.

Preferably the said plate is removable from the main frame for cleaning and is adjustable in position thereto and lockable in an adjusted position.

Conveniently the shroud for the said second handle means is integrally formed and co-extensive with a flat plate member which is adapted to engage the rear of a slab of material such as within the magazine for pushing the material in a forward direction.

Conveniently the thrust exerting member is slidable mounted on an elongate member forming part of or integrally formed with the said magazine.

Preferably the said first handle means comprises a first section secured to and extending from the sub-frame and a second section which extends from the said main frame and is secured thereto and extends close to the said first section of the said first handle means. In this way it is possible for the two sections to be gripped by the one hand and urged into contact thereby moving the sub-frame relative to the main frame which latter is fixed in a direction perpendicular to the plane of the blade but is free to move in a direction parallel to the plane of the blade.

Preferably stop means is provided to restrict the forward movement of the thrust exerting member relative to the sub-frame and thereby prevent the thrust exerting member from interfering with the blade.

Preferably second stop means is also provided at the opposite end of the travel of the thrust exerting member to prevent the latter from leaving the guide means on which it slides.

The provision of these two stops enhances the safety of the machine.

According to another modification of the present invention, a limit is imposed on the travel of the sub-frame relative to the main frame so that where two parts are drawn together by a squeeze grip to produce the forward movement of the sub-frame relative to the main frame, the two parts are in fact prevented from coming into contact as a result of the said limit on the sub-frame travel. By incorporating this feature, it is impossible for the operator's hand to become pinched or trapped between the two parts and this further enhances the safety of the machine since it removes one possible source of distraction which could arise during operation of the machine were the operator to trap and pinch the flesh of one hand between the two members during a cutting operation.

The invention is particularly applicable to a meat cutting bandsaw but it is to be understood that this is merely one application of such a bandsaw and the invention is of general application to all bandsaws of the type having a material support which is movable forwardly and sideways to engage the cutting edge of the saw.

The invention will now be described by way of example with reference to the accompanying drawings, which illustrate the invention as applied to a meat-cutting bandsaw.

IN THE DRAWINGS

Figure 1:
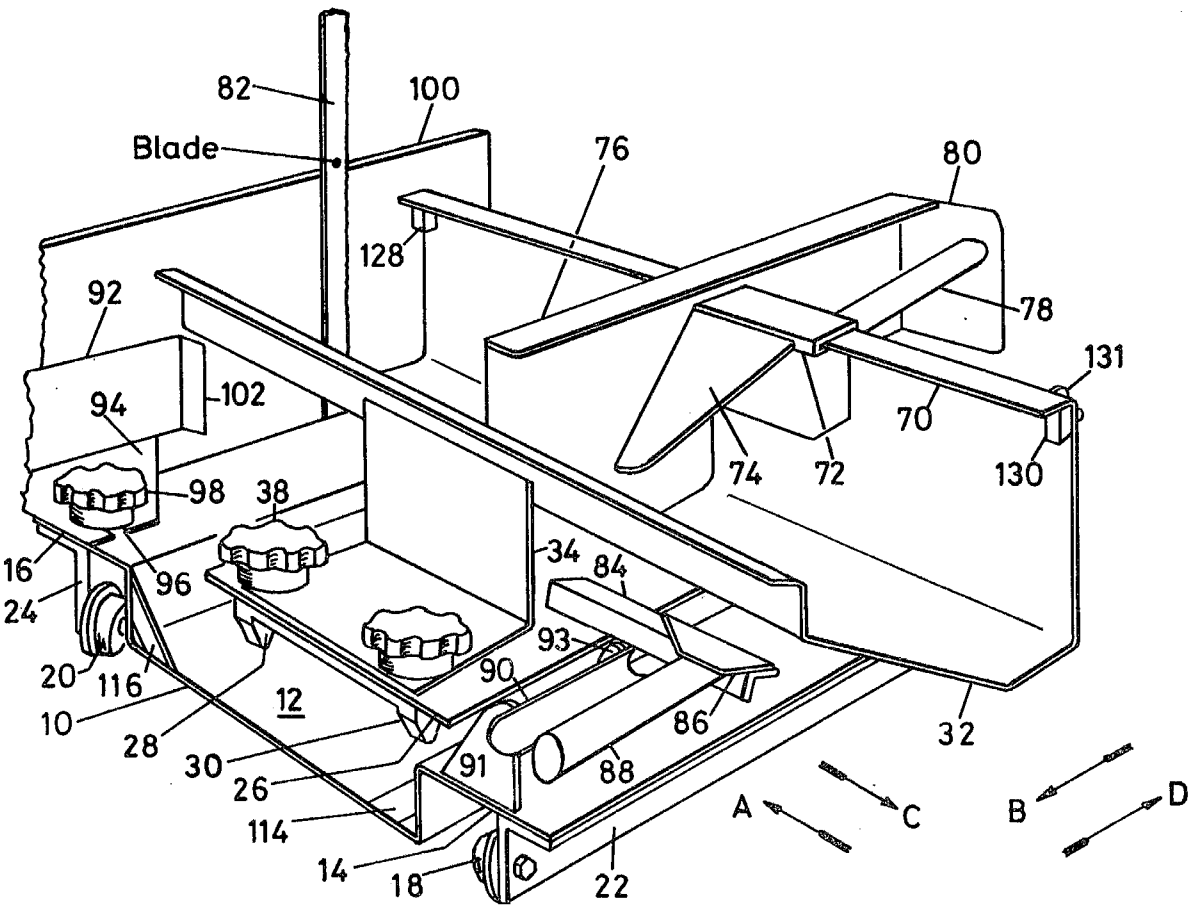
FIG. 1 is a perspective view of a meat cutting jig embodying the invention.
Figure 4:
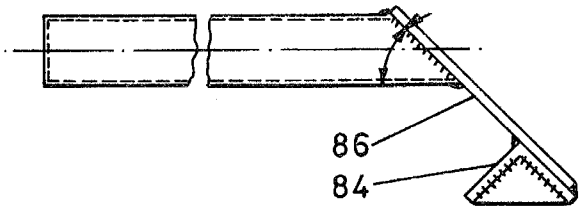
Figure 5:
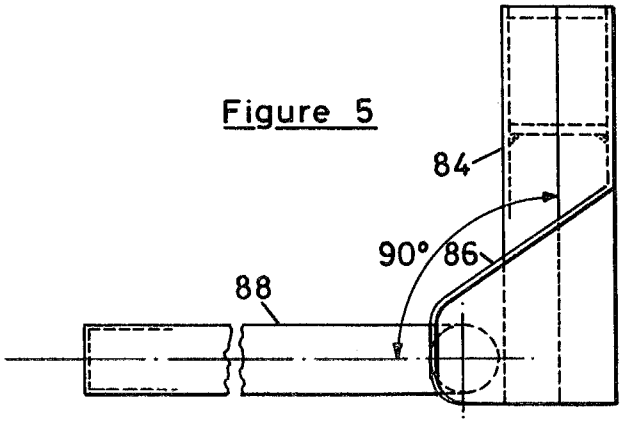
Figure 6:
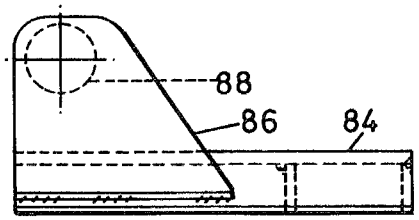
Figure 8:
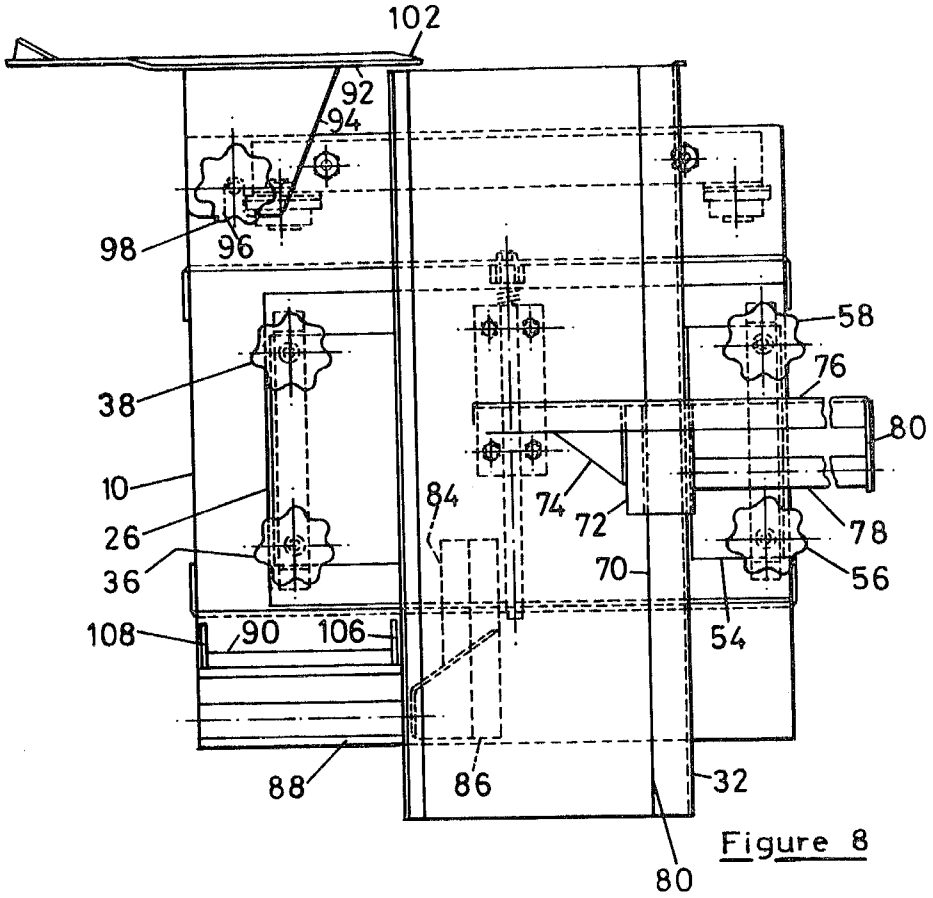
Figure 7:
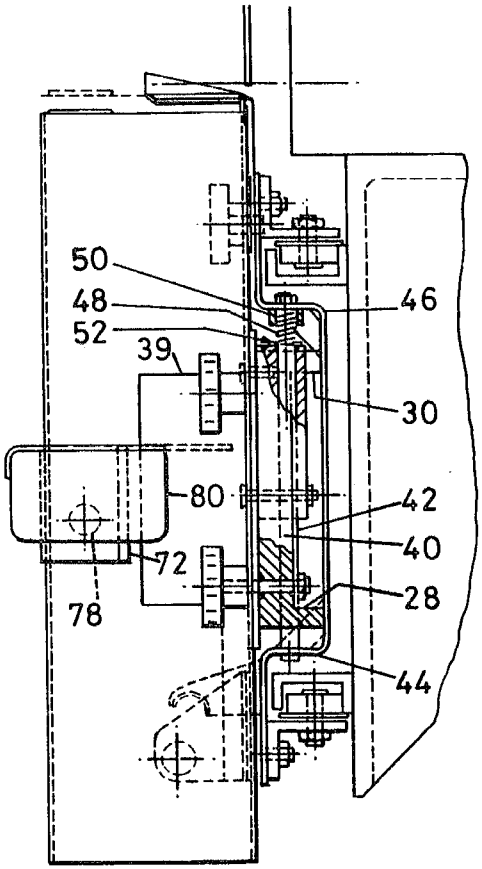

FIG. 4 is a side view of a first section of the said first handle means when viewed in the direction of the arrow A in FIG. 1, FIG. 5 is a top plan view of the said first handle section shown in FIG. 4, FIG. 6 is an end view of the handle structure shown in FIG. 4, FIG. 7 is an end view of the assembly shown in FIG. 1, viewed in the direction of arrow B, and partly in cross-section, and FIG. 8 is a top plan view of the assembly shown in FIG. 1 with the blade and fence removed.

DETAILED DESCRIPTION OF THE DRAWINGS

Referring to FIG. 1, a jig for mounting on a meat cutting bandsaw such as the type AEW 400 as manufactured and sold by AEW Engineering Company Limited of Norwich, includes a main frame generally designated 10 which includes a stepped central region generally designated 12 and overhanging side portions 14 and 16 below which are supported rollers such as 18 and 20 (and other rollers at the opposite ends of the overhanging sections 14 and 16 but not shown in the drawing) which are carried on rotatable supports which themselves are secured through flanges 22 and 24 respectively which extend down and from the said overhanging sections 14 and 16. The size and spacing of the rollers 18 and 20 and the other rollers not shown is such as to allow the main frame to be mounted on and/or in the guide means conventionally provided for a sliding table on a meat cutting bandsaw of the type described.

A sub-frame is at least in part located within the central depressed region 12 and comprises a flat rigid plate 26 the underside of which is formed with sledge runners such as 28 and 30 and the upper side of which has attached thereto an elongate magazine 32 having integrally formed therewith or secured thereto as by welding at least one bracket 34 which is secured to the plate member 26 by means of screw knobs 36 and 38. A similar bracket 39 (see FIG. 7) is provided on the other side of the magazine 32, this bracket 39 not being visible in FIG. 1. The bracket 39 is secured to the plate 26 by means of two more screw knobs 56 and 58 (see FIGS. 7 and 8).

On its underside the plate 26 is secured to a solid bridge member 40 which includes the downwardly extending sledge base feet 28 and 30 (see FIGS. 1 and 7) and the bridge member 40 is apertured across its width so as to receive as a sliding fit therein a circular section shaft 42 (see FIG. 7) one end of which is secured to the upstanding wall section 44 and the other end of which is secured to the upstanding wall section 46 so that it extends across the main frame.

Between one side edge of the bridging member 40 and the upstanding wall 46 is situated a compression spring 48 (see FIG. 7) one end of which is contained within a collar 50 and the other end of which bears against a thrust ring 52. The spring 48 is compressed when the bridge member 40 is moved towards the upstanding wall section 46 and the restoring force exerted by the spring 48 is arranged to force the bridge member 40 in the opposite direction when force needed to overcome the spring 48 and move the bridging member 40 in that said direction is removed.

FIG. 8 shows the four screw knobs which fix the magazine 32 by means of its brackets 34 and 54 respectively to the sub-frame plate 26. Two of the screw knobs (visible also in FIG. 1) are denoted by reference numerals 36 and 38 and the two knobs at the opposite end of the sub-frame (visible in FIGS. 7 and 8) are denoted by reference numerals 56 and 58 respectively.

The magazine includes an elongate in-turned lip 70 which can be seen in both FIGS. 1 and 8 and over and around this lip 70 is fitted a sliding bracket member 72 part of which extends in a downwardly inclined direction and is denoted by reference numeral 74. The member 72 is secured to the rear of a thrust plate generally designated 76 and extending laterally from the bracket 72 is a shaft 78 which constitutes the second handle means previously referred to. The shaft 78 is secured at its opposite end to an end flange 80. In this way the handle formed by the shaft 78 is shrouded and protected from the cutting blade 82 by an extension of the thrust plate 76 and the flange 80.

The sub-frame formed by the plate 26 and the magazine 32 includes an elongate member 84 which is secured to the plate 26 and extends therefrom in a direction parallel to the direction of movement of the sliding assembly 72, 74, 76 etc. Extending from the elongate section 84 and at the end remote from the end which is secured to the plate 26 is a plate 86 from which extends a second shaft 88 which comprises part of the first handle means previously referred to. Cooperating with the shaft 88 is an arcuate cross-section sleeve 90 mounted between brackets 91 and 93 on the overhanging flange 14 of the main frame. The sleeve 90 forms with the shaft 88 a squeeze grip handle.

On the main frame and opposite the squeeze grip handle arrangement 88, 90 is located a meat support plate 92 which includes a lower flange 94 having an aperture 96 to allow the flange to straddle a threaded spigot (not shown) onto which a screwed knob 98 is threaded and turned so as to tighten down on the flange 94 and secure the meat support plate 92 at a desired location relative to the main frame. In particular the meat support plate 92 is aligned with the far side of the blade 82 so that a portion of meat which has been severed by the blade 82 as the jig is moved from right to left in the direction of the arrow B and which is subsequently displaced in the said general direction by the next portion to be severed, will be supported between the meat support plate 92 and the conventional fence 100 shown behind the saw-blade 82.

The leading end of the meat support plate 92 is bent at 102 to form a mouth to facilitate the entry between the plate 92 and fence 100 of a cut portion of meat.

Figure 3:
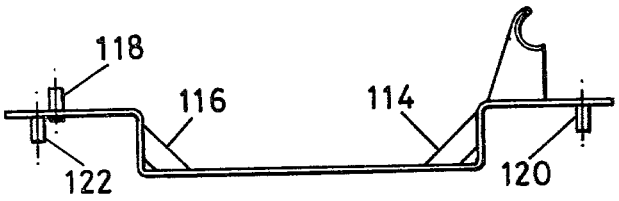
FIG. 3 is an end view of the main frame shown in FIG. 2.
Figure 2:
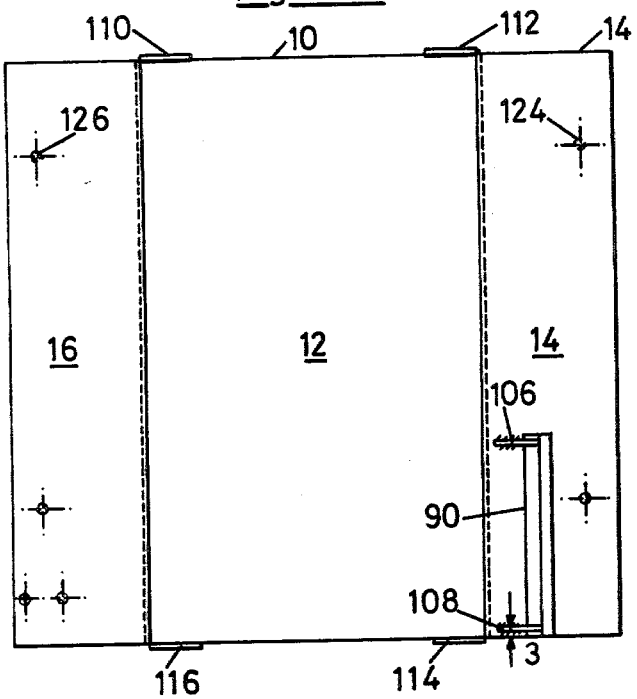
FIG. 2 is a plan view of the main frame section of the jig shown in FIG. 1.

As shown in FIGS. 2 and 3 the main frame is formed from a piece of bent sheet steel and the semi-cylindrical handle section 90 is welded to a pair of brackets 106 and 108 which are in turn welded to one of the overhanging sides 14 of the main frame.

Reinforcing members are provided at 110, 112, 114 and 116 respectively.

Studs are provided at 118 for the meat support plate flange 94 and on the underside of the overhanging sections 14 and 16 at 120 and 122 and as shown in FIG. 2 also at 124 and 126 to allow the right-angled section members 22 and 24 to be bolted to the underside of the overhanging sections 14 and 16 to form the supports for the roller members 18 and 20 etc.

As shown in FIGS. 4, 5 and 6 the complementary handle section 88 is formed from a circular section bar or shaft 88 which is welded or otherwise secured to a flange 86 which is itself welded to a right-angled section bar 84 which extends perpendicularly to the section of shaft 88. The bar 84 is adapted to be welded or otherwise secured to the upper surface of the plate 26 (see FIG. 1) so that the cylindrical bar 88 is aligned with the axis of the semi-circular grip section 90 and the position at which it is welded to the plate 26 determines the distance travelled by the bar 88 before it fits snugly into the semi-circular section 90 and therefore the distance moved forward by the magazine when the handle assembly 88, 90 is squeezed together.

In adapting an existing bandsaw such as the AEW 400 to receive a jig embodying the invention, the sliding table is first removed from the tracks provided therefor on the bandsaw and the jig assembly shown in FIG. 1 is located in position on the rails with the wheels 18 and 20 running thereon. It will thus be seen that the substitution of the jig for the sliding table is essentially very simple and can be achieved without the use of tools or special expertise.

In operation the thrust exerting plate 76 or meat-pusher as it is more commonly referred to is retracted to its rearmost position in the direction of the arrow C in FIG. 1 and a hunk of meat (not shown) which is to be sliced is placed in the magazine in front of the plate 76. At the same time the jig is moved in the direction of the arrow C so that the exit end of the magazine 32 is opposite the fence 100 and is wholly to the right of the saw-blade 82.

Next the squeeze grip 88, 90 is operated by the left hand of the operator so moving the sub-frame 26 forward against the spring pressure.

The meat-pusher 76 is then moved forward (in the direction of arrow A) by pushing with the right hand on the handle 78 keeping the right hand wholly within the shrouded section in front of the handle 78. The meat finally comes to rest against the surface of the fence 100 with the leading section of the meat overhanging the end of the magazine.

The distance between the face of the fence 100 and the saw-blade 82 will determine the thickness of the portion which is to be removed by the saw and in known manner the fence 100 will have been adjusted so that the distance between the two members will give just the right thickness of cut.

With the saw-blade 82 operating the left hand continues to squeeze the squeeze grip 88, 90 and the jig assembly is moved in the direction of the arrow B in FIG. 1 thereby causing the protruding section of meat to be severed from the remaining portion of the meat, the severed section of the meat passing behind the blade 82 and being located between the blade and the fence 100.

Movement of the jig assembly is continued in the direction of the arrow B until the complete cross-section of the hunk of meat has been cut through after which the squeeze grip 88, 90 is released allowing the magazine 32 to return under the action of the spring in the direction of the arrow C in FIG. 1. This causes the cut face of the hunk of meat to be moved back away from the blade 82 and allows the jig assembly to be moved rapidly in the direction of the arrow D to return it to its original position with the exit end of the magazine wholly to the right of the blade 82.

At this point the procedure can be repeated with the operator first squeezing the squeeze grip 88, 90 and then moving the hunk of meat forward (in the direction of arrow A) by pushing on the handle 78 and subsequently moving the jig assembly sideways (in the direction of the arrow B) so as to sever the next piece of meat from the hunk.

It will be seen that the next piece of meat which is cut will also try and occupy the space behind the blade 82 and movement of the jig assembly and hunk of meat (not shown) in the direction of the arrow B to effect the next cut will have the effect of pushing the previously cut slice of meat also in the direction of the arrow B so that it slides into the space between the meat support plate 92 and the fence 100.

The next (third) cut will cause the first piece of meat to be further displaced as the second cut slice of meat obtained by the second cut displaces it yet further in the direction of the arrow B under the influence of the third slice to be cut and pieces can be arranged to fall onto the stationary plate on the other side of the blade 82 to the left of the fence 100 to be retrieved by a packer or other process operator or to fall into a chute (not shown) into which the pieces of cut meat fall and from which they can be retrieved for further processing and packing.

A first stop member 128 is located at the forward end of the magazine 32 under the lip 70 and a second stop member 130 located in a similar position at the rear of the magazine 32 also under the lip 70.

The second stop member 130 is removable and is held in place by a wing nut 131 or any similar device so that the thrust plate 76 and associated component parts can be slid off the magazine for cleaning purposes.

Although there is no reason why the stop member 128 should not be removable from the magazine it is envisaged that in practice this stop member is either a fixture and is for example welded in position or otherwise secured permanently at the front end of the magazine or is at least secured in place by screws which cannot readily be undone without the use of tools so that in the course of a cleaning or maintenance operation the stop member 128 will not normally be removed. In this way the stop member 128 will always be available to limit the travel of the thrust plate 76 and prevent the latter from coming into contact with the blade 82.

A further feature of general safety and improved operation can also be incorporated into the apparatus. This is achieved by selecting carefully the spacing of the two members 88 and 90.

It will be seen that the relaxed position of the member 88 relative to the curved member 90 is determined by the positioning of the elongate member 84 on the plate 26. It can be located relative to the semicircular cross-section sleeve 90 so that the shaft section 88 can fit snugly into the semicircular section 90 when the two members are squeezed together but in practice this can result in the operator's hand becoming trapped or pinched between the member 88 and member 90 and with this in mind the position of the elongate member 84 relative to the plate 26 before the member is welded thereto is adjusted so that when the sub-frame formed from the plate 26 has been moved in the forward direction (i.e. towards the blade 82) to the limit of its travel, the member 88 is still spaced from the member 90 by a small amount so as to prevent any pinching or trapping of the operator's hand.

Although this may seem to be a relatively trivial point it is to be remembered that the purpose of the overall invention is to provide a safer method of portioning meat and any improvement which results in a removal of an operator distraction must result in a safer apparatus particularly when it is borne in mind that a distraction due to pinching between components 88, 90 could occur just at the moment when the sub-frame formed by the plate 26 and components mounted thereon have been moved into the forward position just prior to the instant when the meat is brought into contact with the blade.

I claim:

1. A jig for a bandsaw to facilitate the severing of material by the cutting blade of the bandsaw into portions and adapted to be fitted to a bandsaw, comprising in combination (a) a main frame movable in a first direction parallel to the direction of cut of the cutting blade, (b) a fence situated on the opposite side of the cutting blade to the main frame.

(c) a sub-frame adapted to receive and support a slab of material and mounted on the main frame and movable relative thereto in a second direction which is generally perpendicular to the said first direction so as to allow a slab of material to be moved towards and away from the blade, (d) first handle means for effecting the movement of the sub-frame relative to the main frame, (e) a thrust exerting member slidable relative to the sub-frame in the said second direction, (f) second handle means linked to the said thrust exerting member whereby the latter can be pushed forward from a rest position in the said second direction to urge a slab of material on the sub-frame towards and into contact with the said fence, and (g) means for returning the sub-frame to the said rest position in the event that the operator removes hand pressure from the said first handle means.

2. A jig as set forth in claim 1 in which the first handle means is situated remote from the blade.

3. A jig as set forth in claim 1 in which the second handle means is shrouded on the side thereof which comes into close proximity with the blade when the thrust exerting member is pushed in a forward direction.

4. A jig as set forth in claim 1 in which the sub-frame includes a magazine which is removable from the sub-frame for cleaning and for replacement so that different magazines may be fitted to the jig.

5. A jig as set forth in claim 1 in which the main frame is mounted on rolling members which are adapted to run in guide means.

6. A jig as set forth in claim 1 in which the means for returning the sub-frame includes a spring which exerts a return force on the sub-frame when the forward pressure is removed.

7. A jig as set forth in claim 1 in which the second handle means includes two parts which require a squeeze grip to draw them together and in so doing urge the sub-frame in the said forward direction against the spring return means.

8. A jig as set forth in claim 1 in which a plate is provided on the main frame to provide a support surface parallel to and spaced from the fence for supporting portions of material severed by the blade, behind the latter, by causing them to become sandwiched between the fence and the said plate.

9. A jig as set forth in claim 8 in which the said plate is removable from the main frame for cleaning and is adjustable in position thereto and lockable in an adjusted position thereon.

10. A jig as set forth in claim 1 further comprising stop means to restrict the forward movement of the thrust exerting member relative to the sub-frame to thereby prevent the thrust exerting member from interfering with the blade.

11. A jig as set forth in claim 10 further comprising second stop means at the opposite end of the travel of the thrust exerting member, to prevent the latter from leaving the guide means on which it slides.

12. A jig as set forth in claim 7 in which a limit is imposed on the travel of the sub-frame relative to the main frame so that the two parts which can be drawn together by a squeeze grip to produce a forward movement of the sub-frame relative to the main frame, are prevented from coming closer together than a given distance.

13. A bandsaw comprising, in combination (a) a cutting blade, (b) drive means for driving the cutting blade, (c) a framework supporting the cutting blade and the drive means, (d) a main frame mounted on the framework and movable in a first direction parallel to the direction of cut of the cutting blade, (e) a fence also situated on the framework but on the opposite side of the cutting blade to the main frame, (f) a sub-frame adapted to receive and support a slab of material and mounted on the main frame and movable relative thereto in a second direction which is generally perpendicular to the said first direction so as to allow a slab of material to be moved towards and away from the blade, (g) first handle means for effecting the movement of the sub-frame relative to the main frame, (h) a thrust exerting member slidable relative to the sub-frame in the said second direction, (i) second handle means linked to the said thrust exerting member whereby the latter can be pushed forward from a rest position in the said second direction to urge a slab of material on the sub-frame towards and into contact with the said fence, and (j) means for returning the sub-frame to the said rest position in the event that the operator removes hand pressure from the said first handle means.

* * * * *